United States Patent [19]

Kuchenbecker

[11] 4,180,165

[45] Dec. 25, 1979

[54] BLISTER PACKAGE

[75] Inventor: Morris W. Kuchenbecker, Neenah, Wis.

[73] Assignee: American Can Company, Greenwich, Conn.

[21] Appl. No.: 898,453

[22] Filed: Apr. 20, 1978

[51] Int. Cl.[2] ..... B65D 25/54

[52] U.S. Cl. ..... 206/461; 206/45.31; 206/45.34; 229/9

[58] Field of Search ..... 206/45.14, 45.31, 45.34, 206/461, 467–468, 539; 229/9–11, 19–20

[56] References Cited

U.S. PATENT DOCUMENTS

| | | | |
|---|---|---|---|
| 3,116,154 | 12/1963 | Rumsey, Jr. | 206/45.31 UX |
| 3,670,881 | 6/1972 | Dutcher | 206/45.34 |

FOREIGN PATENT DOCUMENTS

| | | | |
|---|---|---|---|
| 2240024 | 2/1974 | Fed. Rep. of Germany | 206/45.31 |
| 577417 | 7/1976 | Switzerland | 206/45.34 |

*Primary Examiner*—Stephen Marcus

*Attorney, Agent, or Firm*—Robert P. Auber; Ira S. Dorman; George P. Ziehmer

[57] ABSTRACT

A blister package comprises an insert including a blister, and a carton within which the insert is contained. Locking tabs formed from a section of the top wall panel of the carton project inwardly and into engagement with a laterally extending bearing surface provided on the insert. The tabs constrain the insert against the bottom wall panel of the carton, but permit the insert to be slideably disengaged therefrom.

2 Claims, 5 Drawing Figures

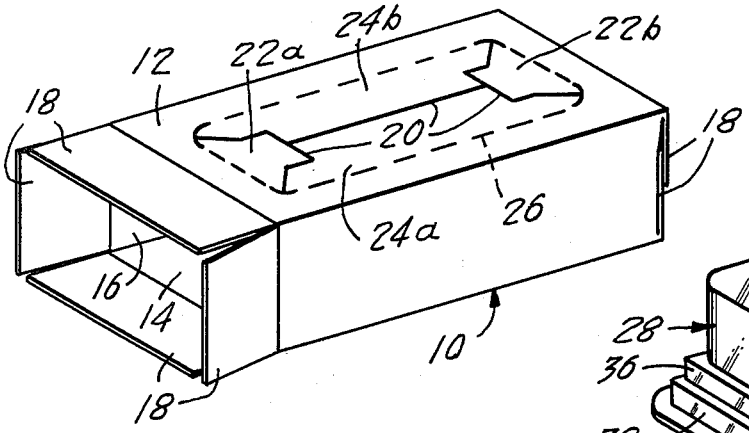
FIG. 1
FIG. 2
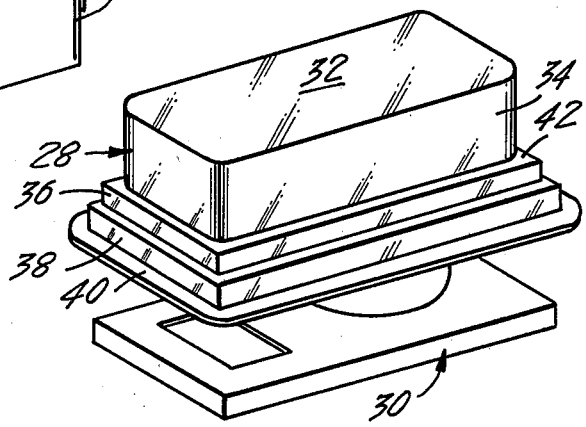
FIG. 3
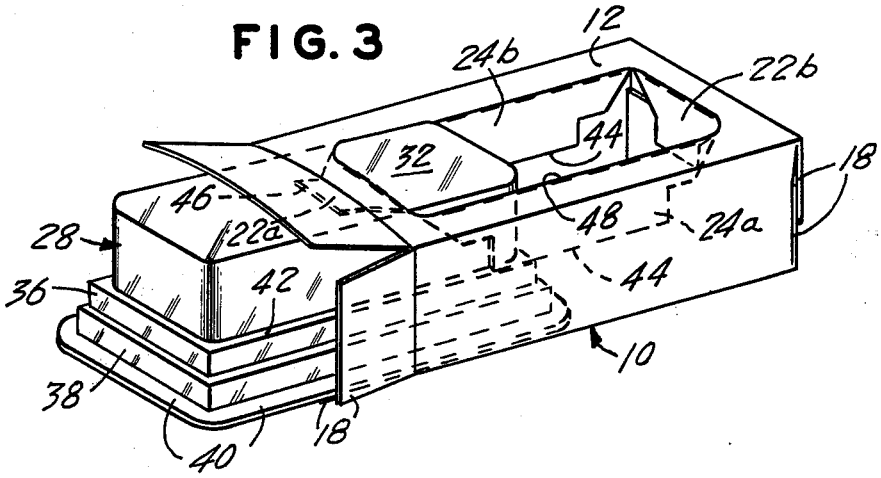
FIG. 4
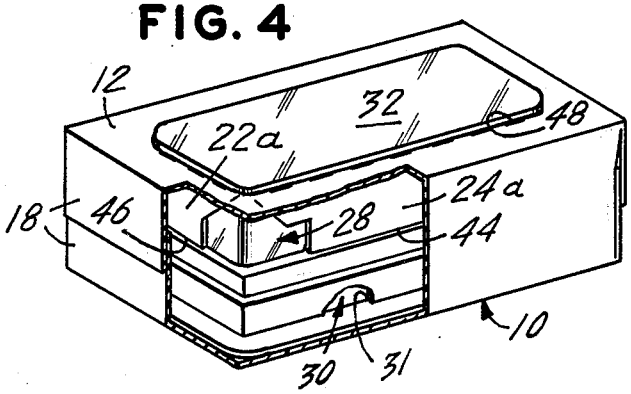
FIG. 5
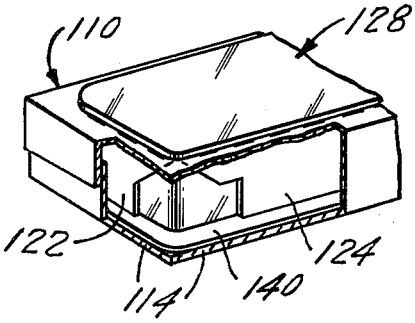

BLISTER PACKAGE

BACKGROUND OF THE INVENTION

Blister packages are in widespread use, and are conventionally formed by affixing a preformed plastic blister to a paperboard backing member. While satisfactory for a wide range of applications, such conventional blister packages generally entail certain disadvantageous features.

Most notably, it is oftentimes difficult to effect the separation of the blister from the backing member, especially in the absence of means provided to facilitate such separation. Moreover, in many instances disassembly of the parts of the package results in the substantial destruction of at least one of the components, making subsequent use of the package impractical, especially if integrity of the package is to be reestablished. In addition, unless special features are incorporated into the package design, or auxiliary means is employed, reclosure of the prior art constructions is not feasible.

Accordingly, it is an object of the present invention to provide a novel blister package wherein closure of the blister cavity is effected without the use of adhesives or other permanent affixing means.

It is also an object of the invention to provide such a package in which the blister may be readily opened to provide convenient access to the packaged product.

Another object is to provide such a package in which reuse is practical, and wherein the reassembled components produce a package which exhibits a high degree of integrity.

Still another object of the invention is to provide a package having the foregoing features and advantages, which is, in addition, relatively simple and inexpensive to manufacture and to use.

SUMMARY OF THE DISCLOSURE

It has now been found that the foregoing and related objects of the invention are readily attained in a blister package comprising an insert, and a carton containing the same. The insert includes a blister having an open side defined by a peripheral edge portion adjacent the bottom of the insert, from which edge portion extends, to an opposite side portion of the blister at the top of the insert, a product-receiving cavity therewithin. The carton is fabricated of relatively rigid web material, and is comprised of a multiplicity of interconnected panels. A first panel supports the insert with the bottom thereof resting thereupon, and a second panel lies over the insert and has an opening therewithin formed by the displacement of a section of the second panel from the plane thereof. The cross-sectional configuration of the opposite side portion of the blister conforms to the opening, and the insert is so dimensioned and configured that the side portion projects thereinto. A shoulder portion, at a location spaced from the top of the insert, provides a laterally extending bearing surface thereon, and the displaced section of the second panel is hingedly connected to the remainder thereof, to provide a locking tab. The tab is disposed to extend below the opposite side portion of the blister and into engagement with the insert on the bearing surface thereof, thereby constraining the insert against displacement from the first panel.

In preferred embodiments of the package, the displaced section of the second panel is comprised of a plurality of locking tabs hingedly connected to the remainder of the panel, and the shoulder portion of the insert provides a bearing surface on which each of the locking tabs is engaged. Generally, the opening of the second panel will be of rectangular configuration, and one of the locking tabs will be disposed on each of at least two opposite sides thereof. Most desirably, a locking tab will be disposed on each side of the opening, and the shoulder portion will extend entirely about the insert.

In certain embodiments, the shoulder portion will be spaced from the bottom of the insert. It may be defined on the blister, and spaced from the edge portion thereof; in particular, the shoulder portion may be provided by an outwardly extending peripheral step portion thereof. Alternatively, the shoulder portion may be provided as an outwardly extending peripheral flange at the edge portion of the blister. Finally, the insert may optionally include a platform member mounted within the edge portion of the blister, and substantially closing the open side thereof.

BRIEF DESCRIPTION OF THE DRAWING

FIG. 1 is a perspective view of a carton comprising a main component of the instant package;

FIG. 2 is an exploded perspective view of an insert comprising the other main component of the package, drawn to the same scale as FIG. 1 and including a blister and a platform member mountable therewithin;

FIG. 3 is a perspective view showing the insert of FIG. 2, partially assembled with the carton of FIG. 1;

FIG. 4 is a perspective view showing the assembled insert and carton, with the carton closed and with segments thereof broken away to show internal features and, in particular, the relationships between the locking tabs and the insert in the completed package; and FIG. 5 is a fragmentary perspective view similar to FIG. 4, showing a second embodiment of the invention, with a segment broken away to show internal features.

DETAILED DESCRIPTION OF THE ILLUSTRATED EMBODIMENTS

Turning now in detail to FIG. 1 of the appended drawing, therein illustrated is a paperboard carton, generally designated by the numeral 10, which comprises a main component of the instant package. The carton 10 includes a top wall panel 12, a bottom wall panel 14, sidewall panels 16 and end flaps 18, all hingedly interconnected in a conventional manner; appropriate panels and end flaps are secured to one-another (by gluing or locking) to set up the carton, with one end closed, as shown. Defined by appropriate score lines 20 die cut in the top wall panel 12 are end locking tabs or flanges 22*a,b* and side locking tabs 24*a,b*, the function of which will be more fully described hereinbelow. The discontinuous score 26 circumscribing the locking tabs 22,24 provides hinges about which those tabs may be pivoted.

FIG. 2 shows a hollow plastic blister, generally designated 28, and a product-supporting paperboard platform member, generally designated 30, the latter being engageable within the open side 31 of the former to cooperatively provide an insert for the carton 10. The blister consists of a top wall 32, a sidewall 34, an outwardly extending upper peripheral step portion or ledge 36 depending from the lower edge of the sidewall 34, a similar ledge 38 depending from the lower edge of the upper ledge 36, and a bottom peripheral flange 40 extending outwardly from the lower edge of the lower ledge 38 and circumscribing the open side 31 of the blister 28. The top wall 32 and the sidewall 34 cooperatively define the main product-receiving cavity of the blister 28; the upper ledge 36 provides a lateral bearing surface 42 on its upper side; the lower ledge 38 provides a recess for receiving and seating of the platform member 30; and the bottom flange 40 provides a structure conforming in outer dimensions and configuration to the bottom wall panel 14 of the carton 10, thus affording stable support and preventing lateral shifting of the insert within the carton.

As best seen in FIG. 3, assembly of the two main components of the package begins with the inward displacement of the locking tabs 22, 24, it being noted that the tabs **22*b*, 24*a* and 24*b* are pivoted to approximately right-angular positions relative to the top wall panel 12, whereas tab 22*a* at the loading end of the carton is reversely folded to a position directly under the panel. During insertion, the outermost edges 44 of the side locking tabs 24 ride upon the bearing surface 42 of the blister 28, and they remain engaged thereagainst in the completely assembled condition depicted in FIG. 4. In that condition, the end locking tab 22*a* is pivoted, or of its own accord resiliently snaps, to a right-angular attitude, so that its outermost edge 46 also engages the ledge 36 on the corrseponding portion of the bearing surface 42, and (while not visible in the drawing) end flap 22*b* becomes similarly engaged upon the corresponding portion of the same ledge. As can also be seen, when the blister 28 is fully inserted, its top wall 32 protrudes through the window or opening 48 of the top wall panel 12 of the carton 10, the opening 48 having been formed by displacement of the tabs 22, 24, and being defined by the discontinuous score 26**.

Thus, were it not for the locking tabs 22, 24, the insert could slip, at least partially, through the opening, which would of course be intolerable in a package of this sort. Use of the tabs to secure the insert against the bottom wall panel prevents such a result while, at the same time, permitting facile removal of the insert through an opened end of the carton, when desired. Because no adhesively secured member is needed to close the insert (or the blister thereof), the packaged product is readily accessible, and the package itself is entirely suited for reuse.

Turning finally to FIG. 5 of the drawing, a second embodiment is illustrated wherein the insert blister 128 and the carton 110 are much shallower that are those of the preceeding Figures. Consequently, the locking tabs 122, 124 bear directly upon the flange 140 to constrain the blister 128 against the bottom wall panel 114, there being no need to form the blister 128 with a ledge (such as 36 of FIGS. 1–4), as when the package is deeper. All other parts of the package of FIG. 5 are similar to those already described, or will be readily evident to those skilled in the art, and need not therefore be discussed in detail. However, it should be noted that the insert of this package includes no platform member, such as 30 of the other embodiment, the desirability thereof depending largely upon the nature of the product to be packaged.

From the two embodiments disclosed, it will be appreciated that the construction of the insert employed and the features of the associated carton are closely interdependent. Since the locking tabs are produced from the material displaced from the top wall panel to form the opening thereof, their length (i.e., the distance from the hinge to the outer edge of the tab) is limited thereby. Generally (as in the illustrated embodiment), tab length will equal one-half of the smallest dimension of the displaced section. However, if the section were used to provide only one or two tabs, their lengths could be greater. Of course, the fewer the tabs employed, the less uniform and secure will be their locking action; for that reason, four tabs are preferred, and will usually be used when the window is rectangular (it being understood that windows of other configurations, with corresponding locking tab and insert variations, are herein contemplated). While somewhat less secure, the provision of one locking tab along each of two opposite sides (preferably the longer ones) of a rectangular window will, however, also produce a very desirable package.

Normally, and in preferred embodiments, the length of the locking tabs will be substantially equal to the sidewall distance between the top of the blister and the bearing surface of the ledge, flange or other form of the shoulder which is provided on the insert. In that context, it should be appreciated that, when the blister protrudes through the window of the carton (as may be desirable for enhanced product display or other aesthetic purposes), the tabs will be shorter than the distance between the top wall and the bearing surface, the differential being the amount of protrusion of the blister. Indeed, the desire to accommodate an oversize blister may itself prompt the selection of a protrudent design.

Thus, it can be seen that the present invention provides a novel blister package, wherein closure of the blister cavity is effected without the use of adhesives or other permanent affixing means. The blister may be readily opened to provide convenient access to the packaged product, and reuse is practical, the reassembled components producing a package which exhibits a high degree of integrity. In addition, the package of the invention is relatively simple and inexpensive to manufacture and to use.

Having thus described the invention, I claim:

1. A package comprising a carton and an insert receivable within said carton, said insert including a blister element open at the bottom thereof and forming a cavity for receiving the packaged product, said blister element including a portion thereof extending outwardly and laterally from said cavity and forming a bearing surface; said carton comprising a multiplicity of interconnected panels including a first panel adapted to support said insert and a second panel adapted to overlie said insert, said second panel having an opening therewithin formed by one or more portions of said second panel being turned inwardly to form respective locking tabs depending generally downwardly from said second panel for bearing against said bearing surface thereby to hold said insert in place against said first panel, said portion of said blister element extending outwardly and laterally from said cavity includes a step portion extending peripherally around said cavity, and wherein said insert further includes a platform member received within said step portion.

2. A package according to claim 1, further comprising a flange extending outwardly and laterally from the lower edge portion of said step portion, said flange extending to the periphery of said first panel to abut the side panels extending upwardly therefrom to hold said insert against lateral displacement.

* * * * *